US005771731A

United States Patent [19]

Rohde et al.

[11] Patent Number: 5,771,731

[45] Date of Patent: Jun. 30, 1998

[54] HOT STRIP PRODUCTION PLANT FOR FERRITIC ROLLING AND METHOD OF PRODUCING FERRITIC ROLLED STRIP

[75] Inventors: Wolfgang Rohde, Dormagen; Manfred Albedyhl, Mettmann, both of Germany

[73] Assignee: SMS Schloemann-Siemag Aktiengesellschaft, Dusseldorf, Germany

[21] Appl. No.: 704,005

[22] Filed: Aug. 22, 1996

[30] Foreign Application Priority Data

Aug. 25, 1995 [DE] Germany ..... 195 31 538.3

[51] Int. Cl.[6] ..... B21B 27/06; B21B 1/00

[52] U.S. Cl. ..... 72/200; 72/201; 72/366.2

[58] Field of Search ..... 72/200, 201, 202, 72/366.2, 40, 237

[56] References Cited

FOREIGN PATENT DOCUMENTS 0226446 6/1987 European Pat. Off. .

2613459 10/1977 Germany .

OTHER PUBLICATIONS

Patent Abstracts of Japan, vol. 12, No. 91, (M–679), Mar. 24, 1988 & JP–A–62 230403 (Kawasaki Steel Corp.) Oct. 9, 1987.

Patent Abstracts of Japan, vol. 016, No. 229 (M–1255) May 27, 1992 & JP–A–04 046608 (Kawasaki Steel Corp.) Feb. 17, 1992.

*Primary Examiner*—Lowell A. Larson
*Assistant Examiner*—Rodney Butler
*Attorney, Agent, or Firm*—Friedrich Kueffner

[57] ABSTRACT

A production plant for producing hot-rolled flat products includes a rolling train composed of a plurality of roll stands, a run-out table with devices for cooling the hot strip, and subsequently arranged coiling machines for coiling the strip. A compact deformation stage in the form of a rolling train with one to four roll stands is arranged following the reeling unit of a conventionally constructed hot-rolled wide strip train. This rolling train is specifically constructed for the deformation in the ferritic range.

10 Claims, 1 Drawing Sheet

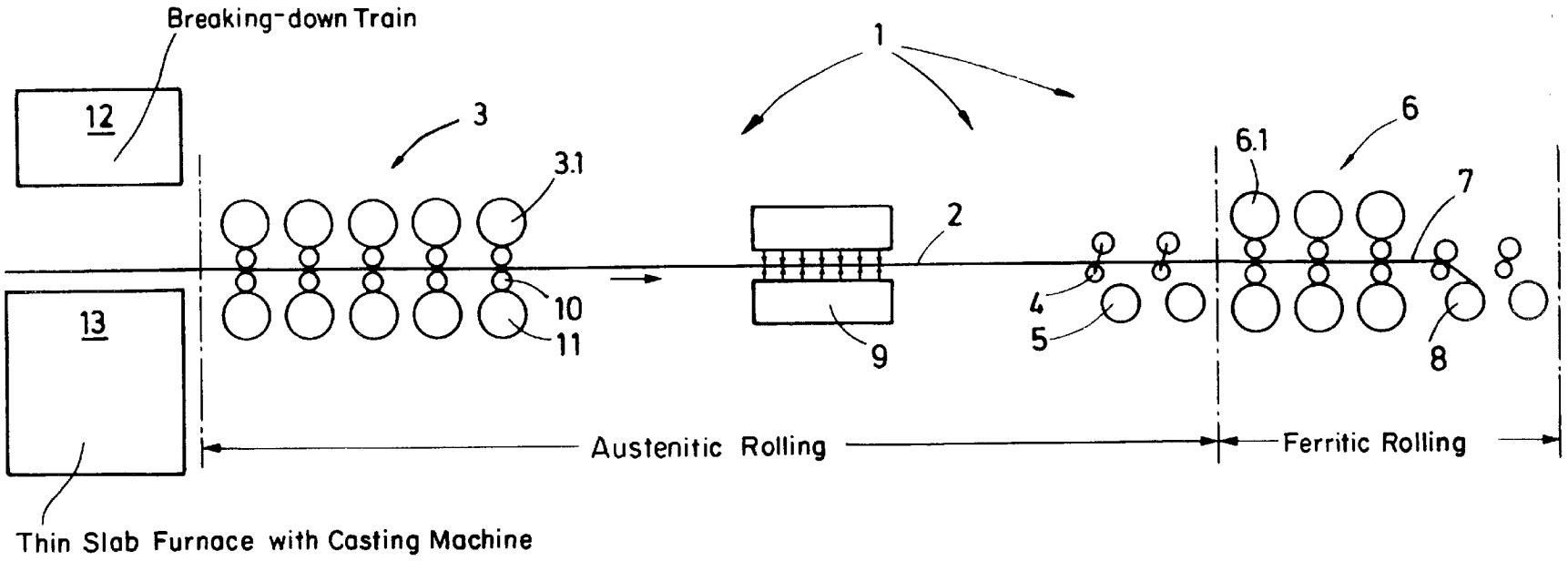
Breaking-down Train
12
3
3.1
10
11
1
2
9
13
Thin Slab Furnace with Casting Machine
Austenitic Rolling
4
5
6
6.1
7
8
Ferritic Rolling

HOT STRIP PRODUCTION PLANT FOR FERRITIC ROLLING AND METHOD OF PRODUCING FERRITIC ROLLED STRIP

BACKGROUND OF THE INVENTION

1. Field of the Invention

The present invention relates to a production plant for producing hot-rolled flat products. The production plant includes a rolling train composed of a plurality of roll stands, a run-out table with devices for cooling the hot strip, and with subsequently arranged coiling machines for coiling the strip.

2. Description of the Related Art

Rolling plants for producing hot-rolled strips are generally constructed and operated today in such a way that the deformation in the individual stands takes place austenitically; this means that it is ensured that the rolling temperatures in the individual roll stands are above the GOS line ($A_3$ line) of the iron/carbon diagram. Cooling to reeling temperature with a structure transformation in the cooling stretch or in the wound-up coil takes place only after the last pass which, for obtaining a fine-grained final structure, should be as close as possible to the GOS line.

In the case of steels having a carbon content of less than 0.2%, for rolling in accordance with the above-described method, the final rolling temperature, i.e., the temperature in the last roll stand of the rolling train, is 840° to 920° C., depending on the carbon content. The final rolling temperature is maintained by selecting the final rolling speed, wherein the drive power of the roll stands is capable of controlling the natural cooling of the strip in the rolling train and the supply of heat. This method can be used without problems for strip thicknesses above a minimum strip thickness, which, depending on the type of rolling train, is in the order of magnitude of 1.3 mm. If the wall thickness drops below this minimum thickness, the required rolling speed reaches values above 12 meter per second; this speed is so high that the strip can no longer be handled at the free runout on the roller table following the rolling train.

In spite of the problems discussed above, the tendency is to develop smaller final thicknesses; this means that the tendency was to reduce the final rolling temperature in order to facilitate slower rolling speeds. These rolling processes have become known under the name ferritic rolling because they take place at temperatures below the GOS line, i.e., in the range of the alpha, gamma mixed crystals or below the GPS line (border line of homogenous ferritic crystals) in the ferritic range.

In accordance with a preferred method, a break-down rolling is carried out in the austenitic range to an intermediate thickness of 2 to 8 mm and finish rolling is carried out in the ferritic range to the smallest final thicknesses below 1.3 mm. Between these two process stages, the rolling stock must be cooled from the final rolling temperature in the austenitic range to the rolling temperature in the ferritic range. This means a cooling from the temperature range of 840° C. to 920° C. to the temperature range of 600° C. to 780° C.

The final rolling temperature following the second deforming stage is also in the range of 600° to 780° C. and, thus, in an order of magnitude in which a recrystallization of the structure occurs after reeling in the wound-up coil. A structure is produced which facilitates the use of the product without further cold deformation or heat treatment.

An essential requirement for a good result is that a minimum cooling time is maintained for cooling from the austenitic range into the ferritic range. This minimum cooling time must be maintained in order to make it possible that the transformation from austenite to ferrite can take place to sufficient extent. Depending on the selected temperature, this minimum cooling time for entering the first ferritic transformation is 10 to 200 seconds.

The realization of the above-described process is very difficult in a conventional rolling train for hot-rolled wide strip. The transformation from the austenitic range into the ferritic range should be carried out in the thickness range of 2 mm to 8 mm, i.e., in a thickness range in which the rolling stock is approximately in the middle of a conventional finishing train. Since the travel time of the strip from one stand to the next stand in the middle of the finishing train takes only a few seconds, it is possible in principle to realize the cooling, however, it is not possible to realize the time required for the transformation. Accordingly, in a conventional rolling train for rolling hot-rolled wide strip, it is not possible to carry out ferritic rolling in accordance with the above-described method.

SUMMARY OF THE INVENTION

Therefore, it is the primary object of the present invention to provide a production plant for the ferritic rolling of hot strip in which the above-described disadvantages and problems are eliminated. Another object of the invention is to provide a method which makes it possible to carry out finish-rolling of hot strip without problems in the ferritic range.

In accordance with the present invention, in a production plant of the above-described type, the object is met by providing a compact rolling train with one to four roll stands following the reeling unit of a conventionally constructed hot-rolled wide strip train.

The rolling train provided in accordance with the present invention is specifically constructed for the deformation in the ferritic range. Thus, the rolling train is equipped with work roll diameters of less than 500 mm as well as with adjusting circuits and control circuits for obtaining strip tolerances for thickness and planeness as they are required of cold-rolled products.

The various features of novelty which characterize the invention are pointed out with particularity in the claims annexed to and forming a part of the disclosure. For a better understanding of the invention, its operating advantages, specific objects attained by its use, reference should be had to the drawing and descriptive manner in which there are illustrated and described preferred embodiments of the invention.

BRIEF DESCRIPTION OF THE DRAWING

In the drawing:

The single FIGURE of the drawing is a schematic view of a hot strip production plant according to the present invention.

DESCRIPTION OF TEE PREFERRED EMBODIMENTS

The drawing shows a conventionally constructed hot-rolled wide strip train 3 which, in the total sequence of the rolling process, carries out the production of an intermediate thickness by rolling in the austenitic range and the compact ferritic deformation stage 6 carries out final rolling in the ferritic range. The deformation stage 6 is composed of four-high stands 6.1 or six-high stands 6.2 with intermediate rolls 14.

Cooling of the strip having the intermediate thickness from the austenitic range into the ferritic range takes place, in the simplest manner, when the strip travels through the run-out roller table 4 between the austenitic deformation stage 3 and the ferritic deformation stage 6. Because of the length of this roller table, which must be designed for cooling austenitically rolled strips to reeling temperature, the resulting run-through times ensure that the necessary cooling usually occurs in the case of ferritic rolling and that the austenite is converted to ferrite.

If necessary, the cooling units 9 provided for the austenitic rolling process can additionally be utilized for achieving the necessary cooling rate. Should the run-through time from the last austenitic deformation 3.1 to the first ferritic deformation 6.1 not be sufficient for a sufficient conversion from austenite to ferrite, a heated loop storing unit, not shown, is provided, wherein the loop storage unit is to be arranged immediately between the conventional reeling unit 5 and the compact ferritic deformation stage 6.

Reeling units 8 specifically constructed for winding thin strip 7 are arranged immediately following the compact ferritic deformation stage 6. The construction of such units is possible without problems because it is no longer necessary to take into consideration the requirements of thicker strips with respect to local conditions.

A breaking-down train 12, not shown in detail, or a thin slab furnace with casting machine 13, are arranged in front of the first multiple-stand rolling train 3 of the hot strip production plant 1 for austenitic and ferritic rolling.

The present invention results in the total concept of a production plant which permits in an optimum manner the austenitic process as well as the ferritic rolling process.

While specific embodiments of the invention have been shown and described in detail to illustrate the inventive principles, it will be understood that the invention may be embodied otherwise without departing from such principles.

We claim:

1. A production plant for hot-rolled flat products in the form of strip, the production plant comprising a rolling train including a plurality of roll stands, a run-out table including devices for cooling the strip, and subsequently arranged coiling machines for coiling the strip, further comprising a compact deformation stage arranged in a rolling direction behind the coiling machines, wherein the compact deformation stage comprises a rolling mill having at least one roll stand for rolling thin strips, and wherein the rolling trains including a plurality of roll stands is configured to carry out rolling in the austenitic temperature range and the compact deformation stage arranged following the rolling train in the rolling direction is configured to carry out rolling in the ferritic temperature range at a temperature of between 600° C. and 780° C., and wherein the devices for cooling the strip are configured to cool the strip from the austenitic temperature range to the ferritic temperature range and are arranged in an area of the run-out table between the rolling train and the compact deformation stage.

2. The production plant according to claim 1, comprising special coiling machines for coiling thin strips arranged immediately following the compact deformation stage.

3. The production plant according to claim 1, comprising a heated storage unit arranged in front of the compact deformation stage.

4. The production plant according to claim 1, wherein the rolling mill of the compact deformation stage for rolling in the ferritic temperature range comprises adjusting circuits and control circuits for obtaining strip tolerances for thickness and planeness as in roll stands for cold rolling.

5. The production plant according to claim 2, wherein the compact deformation stage comprises one of four-high stands and six-high stands.

6. The production plant according to claim 5, wherein the roll stands of the rolling train have work rolls having a diameter of less than 800 mm.

7. The production plant according to claim 6, wherein the diameter of the work rolls is less than 400 mm.

8. The production plant according to claim 7, wherein the roll stands of the rolling train include back-up rolls for driving the work rolls.

9. The production plant according to claim 7, wherein the roll stands of the rolling train include intermediate rolls for driving the work rolls.

10. A method of producing hot-rolled flat products in the form of strip in a production plant including a rolling train having a plurality of roll stands, a run-out table including devices for cooling the strip and subsequently arranged coiling machines for coiling the strip and a compact deformation stage arranged following the coiling machines in a rolling direction for rolling thin strips, the method comprising operating the rolling train and the compact deformation stage such that portions of a hot strip are simultaneously travelling through the rolling train and the compact deformation stage, further comprising deforming the hot strip in the rolling train in the austenitic temperature range and subsequently deforming the hot strip in the compact deformation stage in the ferritic temperature range at a temperature of between 600° C. and 780° C.

* * * * *